US010954962B2

(12) United States Patent
Sakaguchi

(10) Patent No.: US 10,954,962 B2
(45) Date of Patent: Mar. 23, 2021

(54) VACUUM PUMP

(71) Applicant: Edwards Japan Limited, Yachiyo (JP)

(72) Inventor: Yoshiyuki Sakaguchi, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 362 days.

(21) Appl. No.: 14/905,110

(22) PCT Filed: Jun. 6, 2014

(86) PCT No.: PCT/JP2014/065154
§ 371 (c)(1),
(2) Date: Jan. 14, 2016

(87) PCT Pub. No.: WO2015/015902
PCT Pub. Date: Feb. 5, 2015

(65) Prior Publication Data

US 2016/0160877 A1 Jun. 9, 2016

(30) Foreign Application Priority Data

Jul. 31, 2013 (JP) ..... JP2013-158629

(51) Int. Cl.

| | |
|---|---|
| ***F04D 19/04*** | (2006.01) |
| ***F04D 29/58*** | (2006.01) |
| ***F04D 19/00*** | (2006.01) |
| ***F04D 29/38*** | (2006.01) |
| ***F04D 29/54*** | (2006.01) |
| ***F04D 29/64*** | (2006.01) |

(52) U.S. Cl.
CPC ..... *F04D 29/5853* (2013.01); *F04D 19/00* (2013.01); *F04D 19/04* (2013.01);
(Continued)

(58) Field of Classification Search
None
See application file for complete search history.

(56) References Cited

U.S. PATENT DOCUMENTS

| | | | | |
|---|---|---|---|---|
| 6,840,736 B2 * | 1/2005 | Ohtachi | ..... | F04D 29/668 415/119 |
| 2002/0039533 A1 * | 4/2002 | Miyamoto | ..... | F04D 29/584 417/313 |
| 2006/0140776 A1 * | 6/2006 | Okudera | ..... | F04D 19/042 417/13 |

FOREIGN PATENT DOCUMENTS

| | | | | |
|---|---|---|---|---|
| EP | 0855517 A2 * | 7/1998 | ..... | F04D 19/04 |
| EP | 1288502 A2 | 3/2003 | | |

(Continued)

OTHER PUBLICATIONS

PCT International Search Report dated Sep. 1, 2014 for corresponding PCT Application No. PCT/JP2014/065154.

(Continued)

*Primary Examiner* — Christopher Verdier
*Assistant Examiner* — Theodore C Ribadeneyra
(74) *Attorney, Agent, or Firm* — Theodore M. Magee; Westman, Champlin & Koehler, P.A.

(57) ABSTRACT

An object is to provide a vacuum pump that enables, without being affected by a flow rate of gas to be discharged, concentrated and efficient heating of only a stator component of an exhaust side gas channel that needs to be heated in order to prevent deposition of products and that also enables prevention of deposition of products in the exhaust side gas channel as a result of the heating, and improvement of pump emission performance. The vacuum pump has a rotor rotatably arranged on a pump base and a gas channel through which gas sucked by rotation of the gas is guided to an outlet port, and further includes heat insulating means for thermally insulating a stator component, which forms an exhaust side gas channel in the gas channel, from other components and heating means for heating the thermally insulated stator component.

8 Claims, 10 Drawing Sheets

(52) U.S. Cl.
CPC ..... *F04D 19/042* (2013.01); *F04D 19/044* (2013.01); *F04D 19/046* (2013.01); *F04D 29/384* (2013.01); *F04D 29/544* (2013.01); *F04D 29/584* (2013.01); *F04D 29/644* (2013.01)

(56) References Cited

FOREIGN PATENT DOCUMENTS

| | | | |
|---|---|---|---|
| EP | 2228539 | A2 | 9/2010 |
| JP | S63227989 | A | 9/1988 |
| JP | H04116295 | A | 4/1992 |
| JP | 3098140 | B2 | 1/1995 |
| JP | H0972293 | A | 3/1997 |
| JP | H09310696 | A | 12/1997 |
| JP | H10205486 | A | 8/1998 |
| JP | 2001132682 | A | 5/2001 |
| JP | 2002021775 | A | 1/2002 |
| JP | 2002115692 | A | 4/2002 |
| JP | 2002180988 | A | 6/2002 |
| JP | 2002285992 | A | 10/2002 |
| JP | 2006037951 | A | 2/2006 |

OTHER PUBLICATIONS

Communication dated Feb. 17, 2017 and Search Report dated Feb. 13, 2017 for corresponding European Application No. 14832961.8.

* cited by examiner

15 HEAT INSULATING SPACER
14 HEAT INSULATING SPACE
} 10 HEAT INSULATING MEANS

15 HEAT INSULATING SPACER
14 HEAT INSULATING SPACE
} 10 HEAT INSULATING MEANS

15 HEAT INSULATING SPACER
14 HEAT INSULATING SPACE
} 10 HEAT INSULATING MEANS

15 HEAT INSULATING SPACER
14 HEAT INSULATING SPACE
} 10 HEAT INSULATING MEANS

VACUUM PUMP

CROSS-REFERENCE TO RELATED APPLICATION

This application is a Section 371 National Stage Application of International Application No. PCT/JP2014/065154, filed Jun. 6, 2014, which is incorporated by reference in its entirety and published as WO2015/015902 on Feb. 5, 2015 and which claims priority of Japanese Application No. 2013-158629, filed Jul. 31, 2013.

BACKGROUND OF THE INVENTION

1. Field of the Invention

The present invention relates to a vacuum pump including a rotor rotatably arranged on a pump base and a gas channel, through which gas sucked by rotation of the rotor is discharged.

2. Description of the Related Art

As a vacuum pump of this type, for example, a composite molecular pump described in Japanese Patent No. 3098140 has been known. The composite molecular pump in Japanese Patent No, 3098140 is configured such that rotors (6 and 3*a*) rotate to allow gas to be sucked through an inlet port (1*a*) and to allow the sucked gas to be discharged through an outlet port (1*b*) (see the description in Paragraph 0024 in Japanese Patent No. 3098140).

As depicted in FIG. 1 and FIG. 2 in Japanese Patent No. 3098140, in the composite molecular pump described in Japanese Patent No. 3098140, an upstream gas channel included in a gas channel through which the sucked gas is discharged includes a plurality of rotor blades (2*a*) and stator blades (2*b*), and a downstream gas channel also included in the gas channel is shaped like a thread groove and includes a rotor (3*a*) and a stator (7*a*).

The composite molecular pump described in Japanese Patent No. 3098140 has a means for preventing products from being deposited in the downstream gas channel including the stator (7*a*) as a stator component as described above. In this means, the stator (7*a*) is thermally insulated by a heat insulating material (support members 9*a*, 9*h*, and 9*c*) and heated by heat radiated by the rotor (3*a*) and heat resulting from friction of gas flowing through the downstream gas channel (see the descriptions in Paragraphs 0025 and 0026 in Japanese Patent No. 3098140).

However, since the heating of the stator (7*a*) in the above-described scheme utilizes the heat radiated by the rotor (3*a*) and the heat resulting from the friction of the gas flowing through the downstream gas channel, the amount of heating changes according to the flow rate of the gas discharged through the downstream gas channel, unavoidably varying the temperature of the stator (7*a*). In particular, when the flow rate of the gas is low, the temperature of the stator (7*a*) fails to be elevated to a predetermined value, disadvantageously precluding deposition of products in the downstream gas channel from being effectively suppressed.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

The present invention has been developed in order to solve the above-described problems. An object of the present invention is to provide a vacuum pump that enables, without being affected by a flow rate of gas to be discharged, concentrated, efficient, and stable heating of only a stator component of an exhaust side gas channel that needs to be heated in order to prevent deposition of products and that also enables prevention of deposition of products in the exhaust side gas channel as a result of the heating, and improvement of pump emission performance.

To accomplish the object, an aspect of the present invention provides a vacuum pump including a pump base, a rotor arranged on the pump base, a supporting and driving means for supporting the rotor so as to enable the rotor to rotate around an axis thereof and rotationally driving the rotor, and a gas channel through which gas sucked by rotation of the rotor is guided to an outlet port, wherein the vacuum pump includes a heat insulating means for thermally insulating a stator component, which forms an exhaust side gas channel in the gas channel, from other components and a heating means for heating the stator component thermally insulated by the heat insulating means.

In the aspect of the present invention, the exhaust side gas channel may be a channel shaped like a thread groove and formed of an outer peripheral surface of the rotor and a thread groove pump stator opposed to the outer peripheral surface, and the stator component may be the thread groove pump stator.

In the aspect of the present invention, the exhaust side gas channel may be a channel formed of a rotor blade disposed on the outer peripheral surface of the rotor and a stator blade that guides gas molecules, to which a momentum acting toward a downstream of the gas channel is applied by the rotor blade, toward the downstream of the gas channel, and the stator component may be the stator blade.

In the aspect of the present invention, the heating means may be structured such that an attachment portion is provided on the stator component and such that a heater is embedded in the attachment portion so as to heat the stator component.

In the aspect of the present invention, the attachment portion of the stator component may be provided with a seal means thereby being disposed on an atmospheric side.

In the aspect of the present invention, the heat insulating means may be structured to thermally insulate the stator component by a heat insulating space and a heat insulating spacer.

In the aspect of the present invention, the pump base may be divided at least into an upper base portion and a lower base portion, and the upper base portion and the lower base portion resulting from the division may be joined together with a fastening means and are structured so as to conduct heat to and from each other.

In the aspect of the present invention, the heat insulating space may be a gap between the pump base and the stator component.

In the aspect of the present invention, the heat insulating spacer may be interposed between the stator component and the pump base located below the stator component, and support the stator component by fastening the stator component to the pump base.

In the aspect of the present invention, a cooling means may be provided in both or one of the upper base portion and the lower base portion.

In the aspect of the present invention, the vacuum pump includes, as the specific components thereof, the heat insulating means for thermally insulating the stator component forming the exhaust side gas channel included in the gas channel, from other components and the heating means for heating the stator component thermally insulated by the heat insulating means, as described above. The aspect thus exerts the following effects (1) and (2).

Effect (1): According to the present invention, the heating means heats the stator component, and thus, the heating is prevented from being affected by the flow rate of discharged gas. Furthermore, the stator component to be heated by the heating means is thermally insulated by the heat insulating means, enabling exclusive, concentrated, efficient, and stable heating of the stator component of the exhaust side gas channel that needs to be made hot in order to prevent deposition of products and also enabling prevention of deposition of products in the exhaust side gas channel as a result of the heating.

Effect (2): In the aspect of the present invention, the stator component heated by the heating means is thermally insulated by the heat insulating means as described above, thus preventing the components other than the stator component from being heated by the heating means. Therefore, the vacuum pump includes components to be prevented from increasing in temperature as a result of the heating by the heating means and from decreasing in strength as a result of the increased temperature, for example, the rotor blade and the stator blade, when the inlet gas channel included in the gas channel is configured as a channel through which gas is discharged using the rotor blade and the stator blade, and enables such components to be effectively prevented from increasing in temperature and decreasing in strength as a result of the increased temperature. Thus, pump emission performance can be enhanced.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIG. 2 is a diagram illustrating a manner of conduction of heat generated by the vacuum pump that is the first embodiment of the present invention, an installation location of a cooling pipe, and the like;

DETAILED DESCRIPTION

The best mode for carrying out the present invention will be described below in detail with reference to the attached drawings.

First Embodiment

Figure 1:
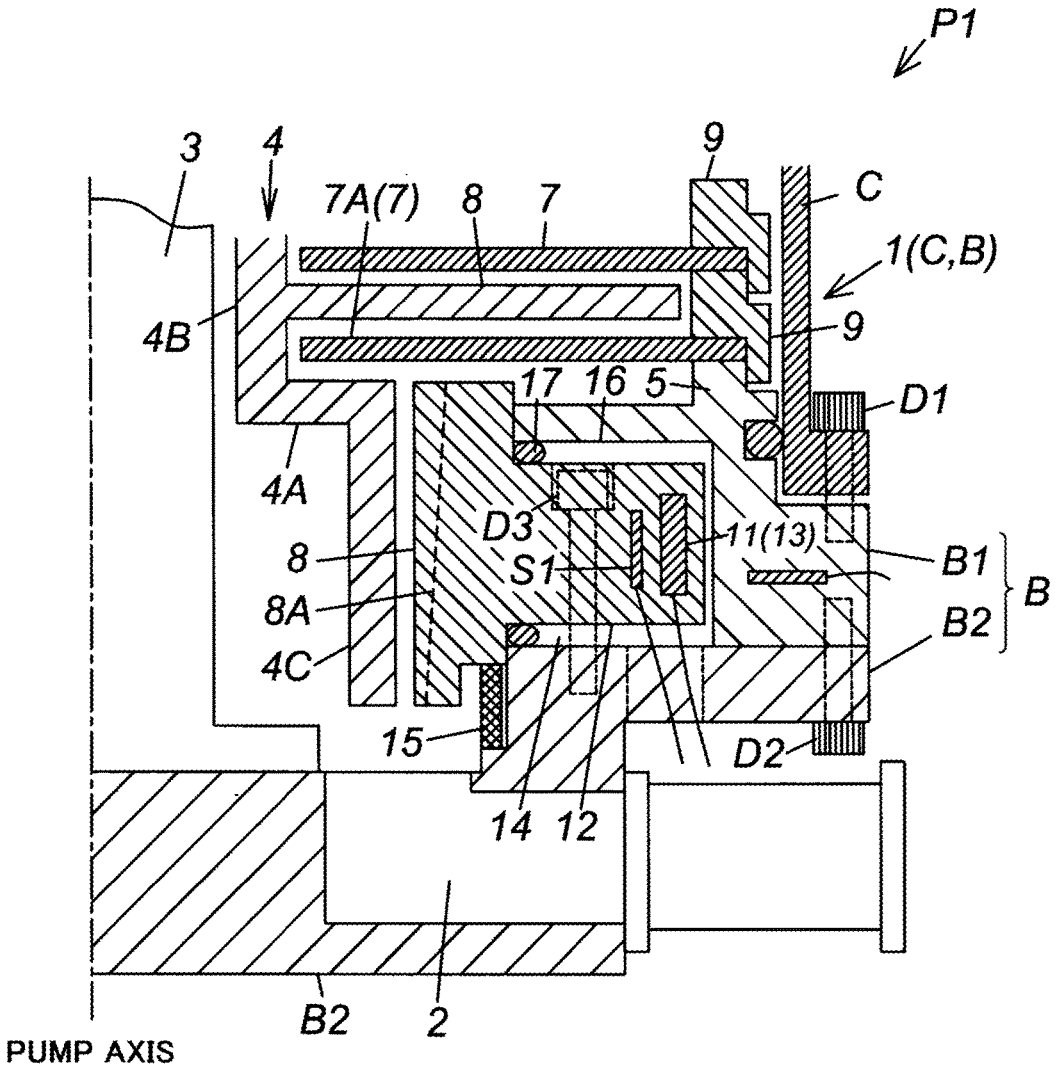
FIG. 1 is a sectional view depicting a part of a vacuum pump that is a first embodiment of the present invention.

FIG. 1 is a sectional view depicting a part of a vacuum pump that is a first embodiment of the present invention. A vacuum pump P1 is utilized as, for example, a gas emission means for a process chamber or another closed chamber in a semiconductor manufacturing apparatus, a flat panel display manufacturing apparatus, and a solar panel manufacturing apparatus.

In the vacuum pump P1 in FIG. 1, a casing 1 is shaped like a bottomed cylinder by integrally coupling a tubular pump case C and a pump base B together in a tubular axial direction with a fastening means D1.

An upper end (the upper side of the sheet of FIG. 1) of the pump case C is open as a gas inlet port (not depicted in the drawings). A gas outlet port 2 is formed in the pump base B. The gas inlet port, is connected to a closed chamber not depicted in the drawings and in which high vacuum is formed, such as the process chamber in the semiconductor manufacturing apparatus. The gas outlet port 2 is connected to an auxiliary pump not depicted in the drawings so as to communicate with the pump.

A cylindrical stator column 3 is provided in an internal central portion of the pump case C. The stator column 3 is erected on the pump base B. A rotor 4 is provided outside the stator column 3. The stator column 3 contains various electrical components not depicted in the drawings, such as a magnetic bearing serving as a means for supporting the rotor 4 and a drive motor serving as a means for rotationally driving the rotor 4. The magnetic bearing and the drive motor are well known, and thus, specific detailed descriptions thereof are omitted.

A stator blade positioning portion 5 is provided at an upper end of the pump base B (specifically, an upper end of an upper base B1 described below). The stator blade positioning portion 5 has a function to position, in a pump axis direction, a lowest stator blade 7A described below by placing the stator blade 7A on the stator blade positioning portion 5.

The rotor 4 is rotatably arranged on the pump base B and is contained in the pump base B and the pump case C. The rotor 4 is shaped like a cylinder surrounding an outer periphery of the stator column 3 and structured such that two tubular members with different diameters (a first tubular member 4B and a second tubular member 4C) are coupled together in a tubular axial direction thereof using a coupling portion 4A that is an annular plate member. The rotor 4 is also structured such that an upper end surface (on the upper side of the sheet of FIG. 1) of the first tubular member 4B is occluded with an end member not depicted in the drawings.

A rotating shaft (not depicted in the drawings) is attached inside the rotor 4. The rotating shaft is supported using a magnetic bearing incorporated in the stator column 3 and rotationally driven by a drive motor incorporated in the stator column 3 to allow the rotor 4 to be supported so as to be rotatable around an axis (rotating shaft) of the rotor 4 and to be rotationally driven around the axis. In this configuration, the rotating shaft, the magnetic bearing incorporated in the stator column 3, and the drive motor function as a supporting and driving means for the rotor 4. A different configuration may be used to support the rotor 4 such that the rotor 4 is rotatable around the axis thereof and to rotationally drive the rotor 4 around the axis thereof.

A gas channel R is provided on an outer peripheral surface side of the rotor 4. The gas channel R allows gas sucked by rotation of the rotor 4 to be guided to the gas outlet port 2.

Suction of the gas is performed through the gas inlet port (not depicted in the drawings).

In the vacuum pump P1 in FIG. 1, in an embodiment of the gas channel R, an inlet gas channel R1 (an upstream of the coupling portion 4A of the rotor 4) corresponding to a former half of the gas channel R includes a rotor blade 6 disposed on an outer peripheral surface of the rotor 4 and a stator blade 7 that guides gas molecules to which a momentum acting toward a downstream of the gas channel R is applied by the rotor blade 6, toward the downstream of the channel R, and the stator component may be the stator blade. A latter half of the exhaust side gas channel R2 (a downstream of the coupling portion 4A of the rotor 4) is shaped like a thread groove and includes the outer peripheral surface of the rotor 4 and a thread groove pump stator 8 lying opposed to the outer peripheral surface.

A configuration of the inlet gas channel R1 will be described in further detail. In the vacuum pump P1 in FIG. 1, a plurality of the rotor blades 6 forming the inlet gas channel R1 is arranged radially around a pump axis such as a rotating center of the rotor 4. On the other hand, a plurality of the stator blades 7 forming the inlet gas channel R1 is fixedly arranged on an inner peripheral side of the pump case C so as to be positioned in a pump diameter direction and a pump axis direction via stator blade positioning spacers 9. The stator blades 7 are also arranged radially around the pump axis.

In the vacuum pump P1 in FIG. 1, the rotor blades 6 and the stator blades 7 radially arranged as described above are alternately arranged in multiple stages along the pump axis to form the inlet gas channel R1.

In the inlet gas channel R1 configured as described above, the drive motor is started to integrally rotate the rotor 4 and the plurality of rotor blades 6 at a high speed such that the rotor blades 6 apply a downward momentum to gas molecules flowing in through the gas inlet port. The gas molecules with the downward momentum are fed into the rotor blade at the next stage by the stator blade 7. The operations of applying the momentum to the gas molecules and feeding the gas molecules as described above are repeatedly performed at multiple stages to allow the gas molecules at the gas inlet port to be discharged through the inlet gas channel R1 so as to be sequentially shifted toward an exhaust side gas channel R2.

Now, a configuration of the exhaust side gas channel R2 will be described in further detail. In the vacuum pump P1 in FIG. 1, the thread groove pump stator 8 forming the exhaust side gas channel R2 is a cylindrical stator component surrounding a downstream outer peripheral surface (specifically, an outer peripheral surface of the second tubular member 4C; this also applies to the following description) of the rotor 4. The thread groove pump stator 8 is arranged such that an inner peripheral surface thereof lies opposed to the downstream outer peripheral surface of the rotor 4 via a predetermined gap.

A thread groove 8A is formed in an inner peripheral portion of the thread groove pump stator 8 and shaped like a tapered cone such that the diameter of the thread groove 8A decreases with increasing depth of the thread groove 8A. The thread groove 8A is spirally engraved from an upper end to a lower end of the thread groove pump stator 8.

The vacuum pump P1 in FIG. 1 adopts the configuration in which the downstream outer peripheral surface of the rotor 4 lies opposed to the thread groove pump stator 8 with the thread groove 8A so as to form the exhaust side gas channel R2 as a thread groove-like gas channel. Another embodiment may adopt a configuration in which, for example, the thread groove 8A is formed in the downstream outer peripheral surface of the rotor 4 so as to form the exhaust side gas channel R2 as described above, though the configuration is not depicted in the drawings.

In the exhaust side gas channel R2 configured as described above, when the drive motor is started to rotate the rotor 4, gas flows in through the inlet gas channel R1. A drag effect exerted between the thread groove 8A and the downstream outer peripheral surface of the rotor 4 acts to feed the inflow gas while compressing a transient flow into a viscous flow.

Description of the Heat Insulating Means and the Heating Means

In the vacuum pump P1 in FIG. 1, the stator component forming the exhaust side gas channel R2, that is, the thread groove pump stator 8, is thermally insulated from the other components by a heat insulating means 10. The thus thermally insulated thread groove pump stator 8 is configured to be directly heated by a heating means 11 on the basis of heat conduction.

Specific example configurations of the heat insulating means 10 and the heating means 11 will be described. In the vacuum pump P1 in FIG. 1, the heating means 11 is structured such that a attachment portion 12 is provided on an outer peripheral surface of the thread groove pump stator 8, and a heater 13 is embedded in the attachment portion 12 so as to directly heat the thread groove pump stator 8 based on heat conduction. The heat insulating means 10 is structured such that a heat insulating space 14 that is a gap between the pump base B and the thread groove pump stator 8 (stator component) is set around the attachment portion 12 and such that the whole thread groove pump stator 8 including the attachment portion 12 is supported by a heat insulating spacer 15.

A temperature sensor S1 for heater control is also embedded in the attachment portion 12. The temperature of the heater 13 is controlled based on a detection signal from the temperature sensor S1.

To allow for the use of the heat insulating space 14 and the heat insulating spacer 15 in the vacuum pump P1 in FIG. 1, the following <Configuration 1> to <Configuration 4> are adopted.

Configuration 1

The pump base B is divided at least into an upper base portion B1 and a lower base portion B2, and the upper base portion B1 and the lower base portion B2 resulting from the division are joined together with a fastening means D2 and are structured so as to conduct heat to and from theses base portions B1 and B2.

Configuration 2

A recess portion 16 lying opposed to the downstream outer peripheral surface of the rotor 4 in conjunction with the junction in the <Configuration 1> is formed in an inner surface of the pump base B. The attachment portion 12 of the thread groove pump stator 8 is assembled into the recess portion 16 via a predetermined gap, which is utilized as the heat insulating space 14. In this configuration, to position the thread groove pump stator 8 in a pump radial direction, the pump base B and the thread groove pump stator 8 are in contact with each other at an edge of the recess portion 16. However, no external force (For example, a fastening force exerted by a fastening bolt) acts on this contact portion, and thus, substantially no heat conduction occurs via the contact portion.

Configuration 3

The heat insulating spacer 15 is interposed between the thread groove pump stator 8 and the pump base B (specifically, the lower base B2) located below the thread groove pump stator 8. The thread groove pump stator 8 and the pump base B are clamped together (specifically, the attachment portion 12 of the thread groove pump stator 8 and the lower base B2 are clamped together with a fastening means D3) to support the thread groove pump stator 8.

Configuration 4

A wire for the heater 13 is drawn out from the attachment portion 12 of the thread groove pump stator 8. When the attachment portion 12 is exposed to high vacuum, the heater 13 and the wire therefor may be subjected to dielectric breakdown. Thus, in the vacuum pump P1 in FIG. 1, a seal means 17 such as an O ring is provided on an outer peripheral surface of the attachment portion 12 so as to allow the attachment portion 12 to be disposed on the atmospheric side.

Description of the Cooling Pipe as Cooling Means

Figure 2:
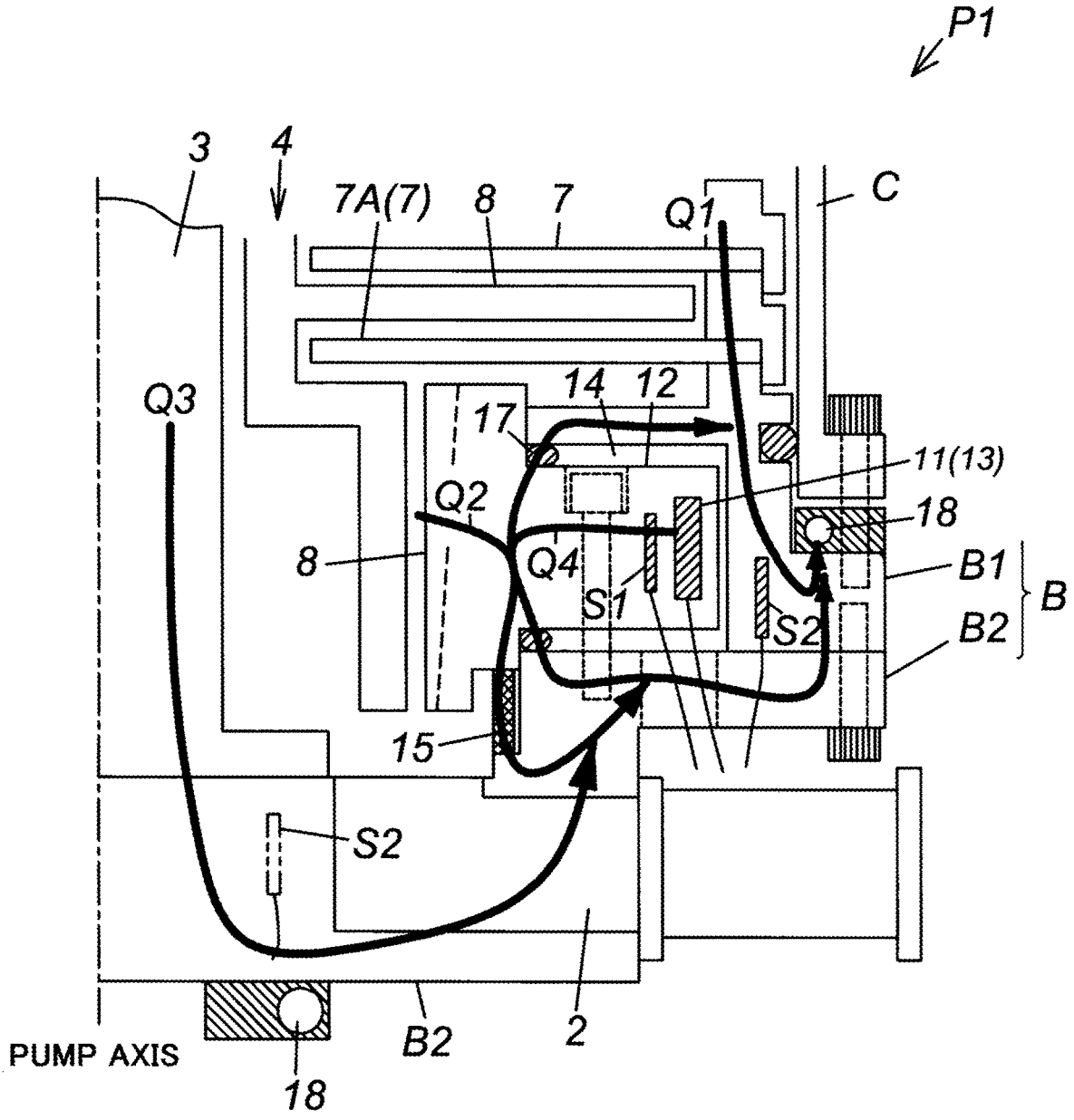

FIG. 2 is a diagram illustrating a manner of conduction of heat generated by the vacuum pump that is the first embodiment of the present invention, an installation location of a cooling pipe, and the like.

In FIG. 2, heat conducting from the stator blades 7 to the upper base B1 based on heat conduction is denoted by Q1. Heat conducting from the rotor 4 to the thread groove pump stator 8 by radiation and the manner of the conduction are denoted by Q2. Heat conducting from the stator column 3 to the lower base B2 based on heat conduction is denoted by Q3. Heat conducted by heating by the heater 13 and the manner of the conduction are denoted by Q4.

In the vacuum pump P1 in FIG. 1, a cooling pipe 18 may be provided both in the upper base B1 and in the lower base B2 as a cooling means or one of the cooling pipes 18 may be exclusively adopted, as depicted in FIG. 2.

The cooling pipe 18 in the upper base B1 functions as a means for mainly cooling heat conducting from the thread groove pump stator 8 to the upper base B1 or the lower base B2 via the heat insulating spacer 15 or the seal means 17 like the heat Q2 or Q4, and heat conducting from the stator blades 7 to the upper base B1 based on heat conduction like the heat Q1.

On the other hand, the cooling pipe 18 in the lower base B2 functions as a means for mainly cooling the heat Q3 conducting from the stator column 3 to the lower base B2 based on heat conduction.

Although not depicted in the drawings, in the vacuum pump P1 in FIG. 1, each of the cooling pipes 18 is provided with an operation valve such that operating the respective valves allows the flow rates of cooling media flowing through the corresponding cooling pipes 18 to be individually adjusted.

One of the following configurations may be adopted: a configuration in which a temperature sensor (hereinafter referred to as the temperature sensor S2 for water cooling pipe valve control) used to control the operation valves (not depicted in the drawings) of the cooling pipes 18 is provided near the cooling pipe 18 installed in the upper base B1, a configuration in which the temperature sensor is provided near the cooling pipe 18 installed in the lower base B2, or a configuration in which the temperature sensor is provided near both the cooling pipes 18.

The vacuum pump P1 in FIG. 1 described above adopts the configuration in which the thread groove pump stator 8, serving as a stator component forming the exhaust side gas channel R2 included in the gas channel, is thermally insulated from the other components by the heat insulating means 10 and in which the thus thermally insulated thread groove pump stator 8 is directly heated by the heating means 11 based on heat conduction. Thus, an <effect 11> and an <effect 2-1> are produced.

Effect 1-1

In the vacuum pump P1 in FIG. 1, the heating means 11 directly heats the thread groove pump stator 8 based on heat conduction, and thus, the heating is prevented from being affected by the flow rate of discharged gas, as described above. Furthermore, the thread groove pump stator 8 to be heated is thermally insulated by the heat insulating means 10, enabling concentrated and efficient heating of only the thread groove pump stator 8 that needs to be made hot in order to prevent deposition of products and also enabling prevention of deposition of products in the exhaust side gas channel R2 as a result of the heating.

Effect 2-1

Moreover, in the vacuum pump P1 in FIG. 1, the thread groove pump stator 8, which is heated by the heating means 11, is thermally insulated by the heat insulating means 10 as described above, thus preventing the components other than the thread groove pump stator 8 from being heated by the heating means 11. Therefore, the vacuum pump P1 includes components to be prevented from increasing in temperature as a result of the heating by the heating means 11 and from decreasing in strength as a result of the increased temperature, for example, the rotor blades 6 and the stator blades 7, and enables such components to be effectively prevented from increasing in temperature and decreasing in strength as a result of the increased temperature. Thus, pump emission performance can be enhanced.

Temperature Control for the Vacuum Pump Using the Heating Means (Heater) and the Cooling Means (Cooling Pipes)

Figure 3:
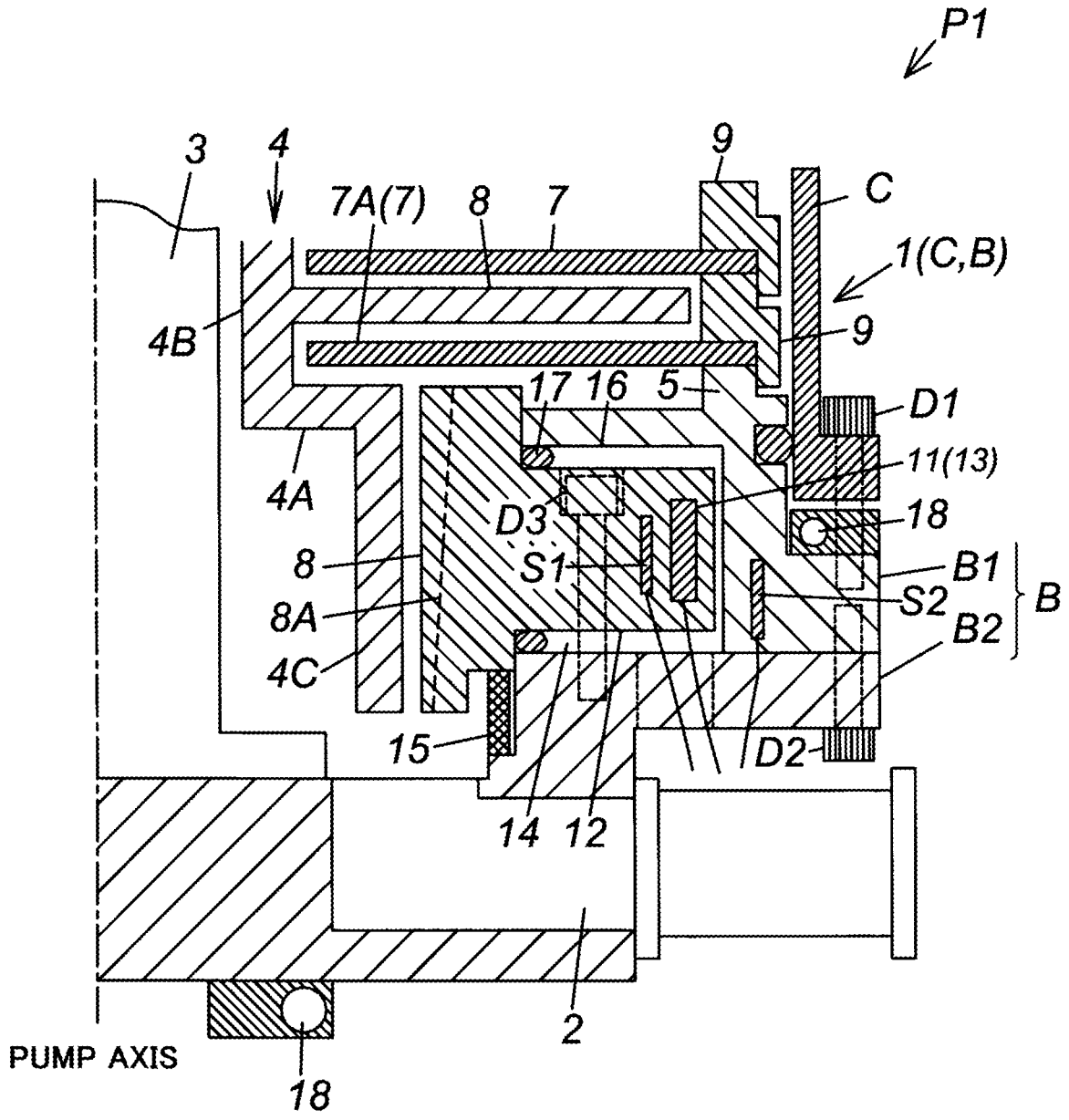
FIG. 3 is a diagram illustrating an example of temperature control in a vacuum pump P1 in FIG. 2.
Figure 4:
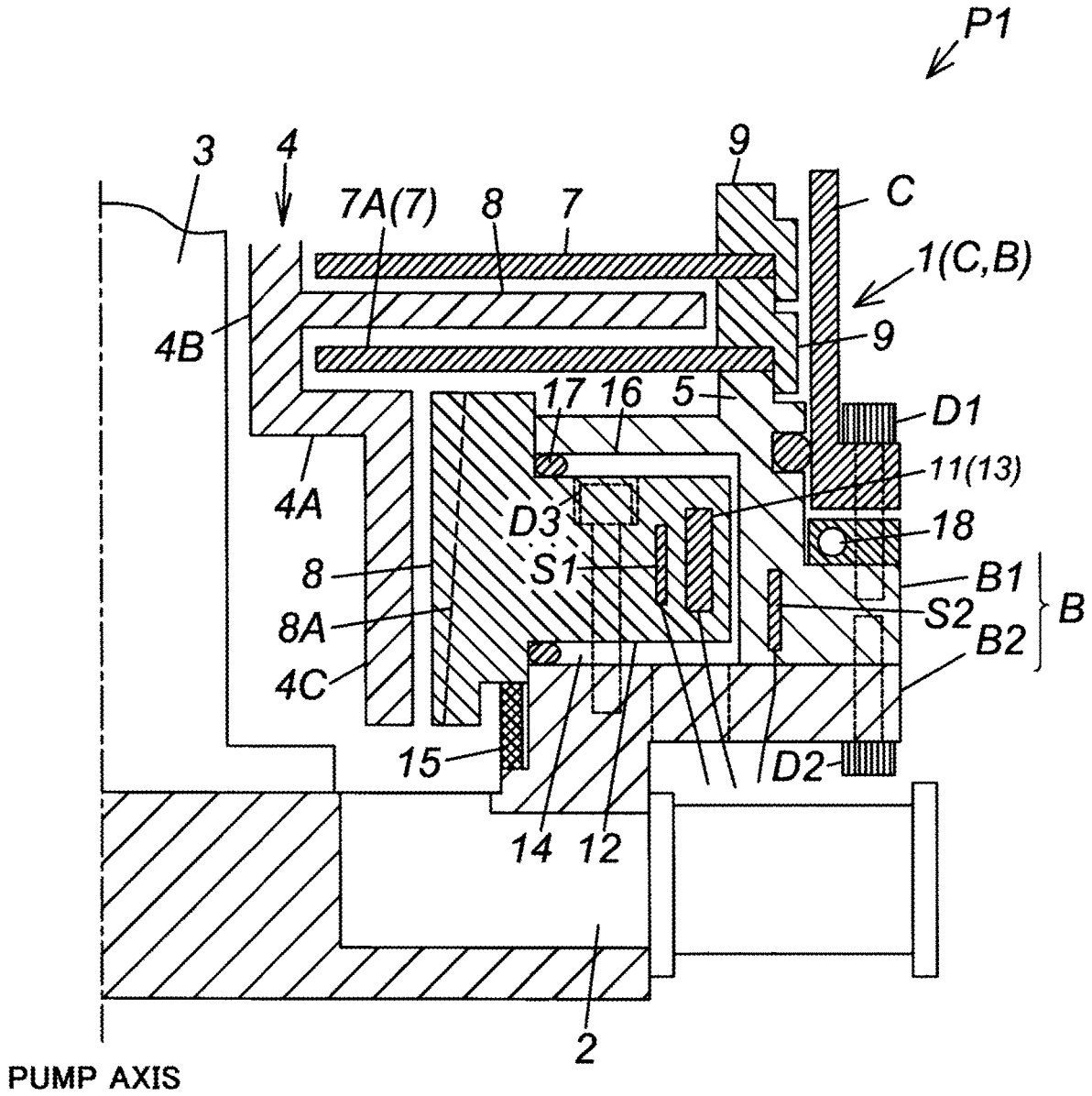
FIG. 4 is a diagram illustrating an example of temperature control in the vacuum pump P1 in FIG. 2.
Figure 5:
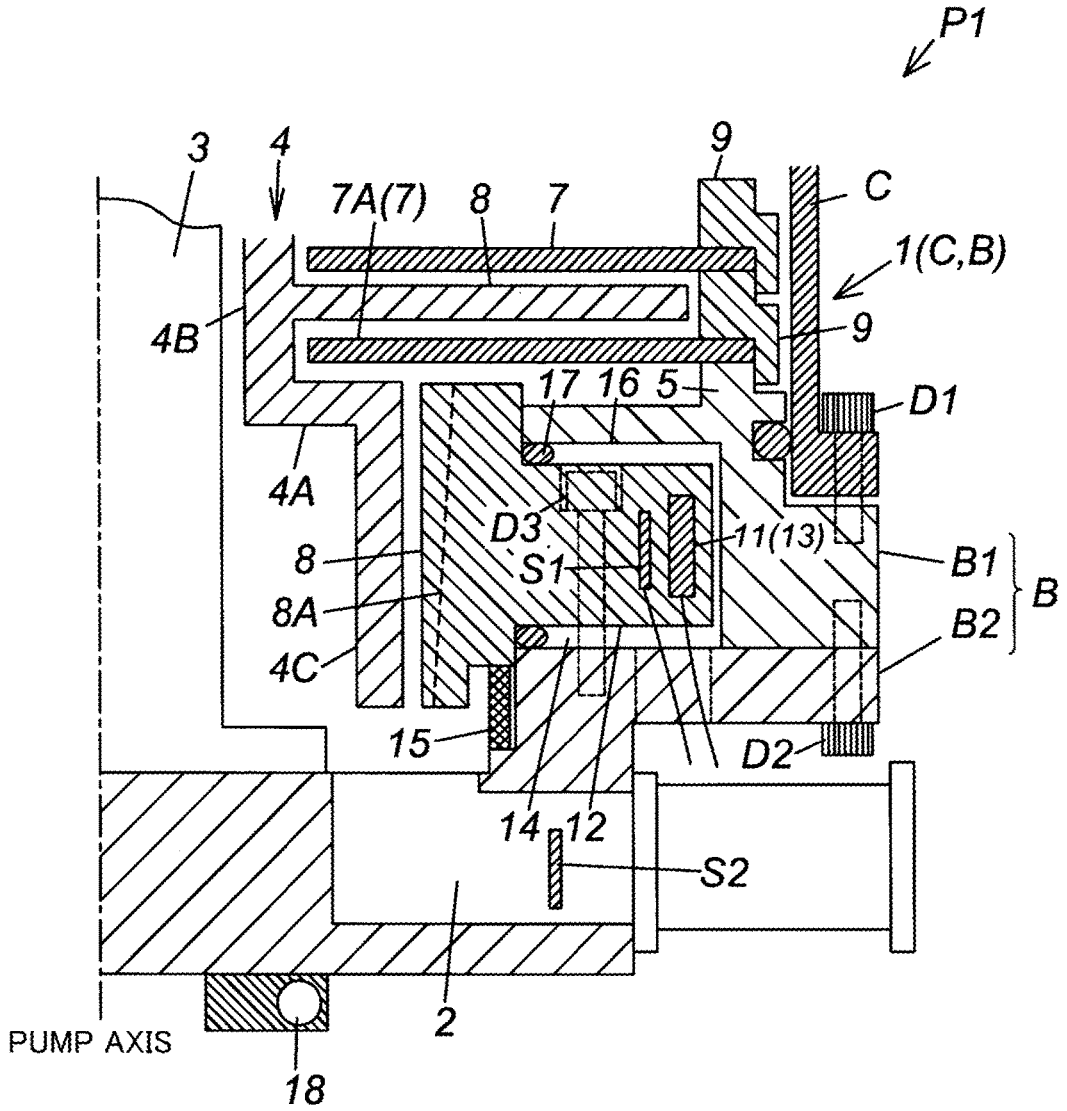
FIG. 5 is a diagram illustrating an example of temperature control in the vacuum pump P1 in FIG. 2.

FIGS. 3 to 5 are diagrams illustrating an example of temperature control for the vacuum pump P1 in FIG. 2.

In the example of temperature control in FIGS. 3 to 5, temperature control with the heater 13 and temperature control with the cooling pipes 18 are independently performed. The temperature control with the heater 13 involves controlling the temperature of the heater 13 based on a detection signal from the temperature sensor S1 for heater control installed in the thread groove pump stator 8. The temperature control with the cooling pipes 18 involves controlling the operation valves for the cooling pipes 18 based on a detection signal from the temperature sensor S2 for cooling pipe valve control. All examples of temperature control are the same in this regard.

The examples of temperature control in FIGS. 3 to 5 are different from one another in installation locations of the cooling pipes 18. In the example of temperature control in FIG. 3, the cooling pipe 18 is installed both in the upper base B1 and in the lower base B2. In the example of temperature control in FIG. 4, the cooling pipe 18 is provided only in the upper base B1. In the example of temperature control in FIG. 5, the cooling pipe 18 is provided only in the lower base B2.

Figure 6:
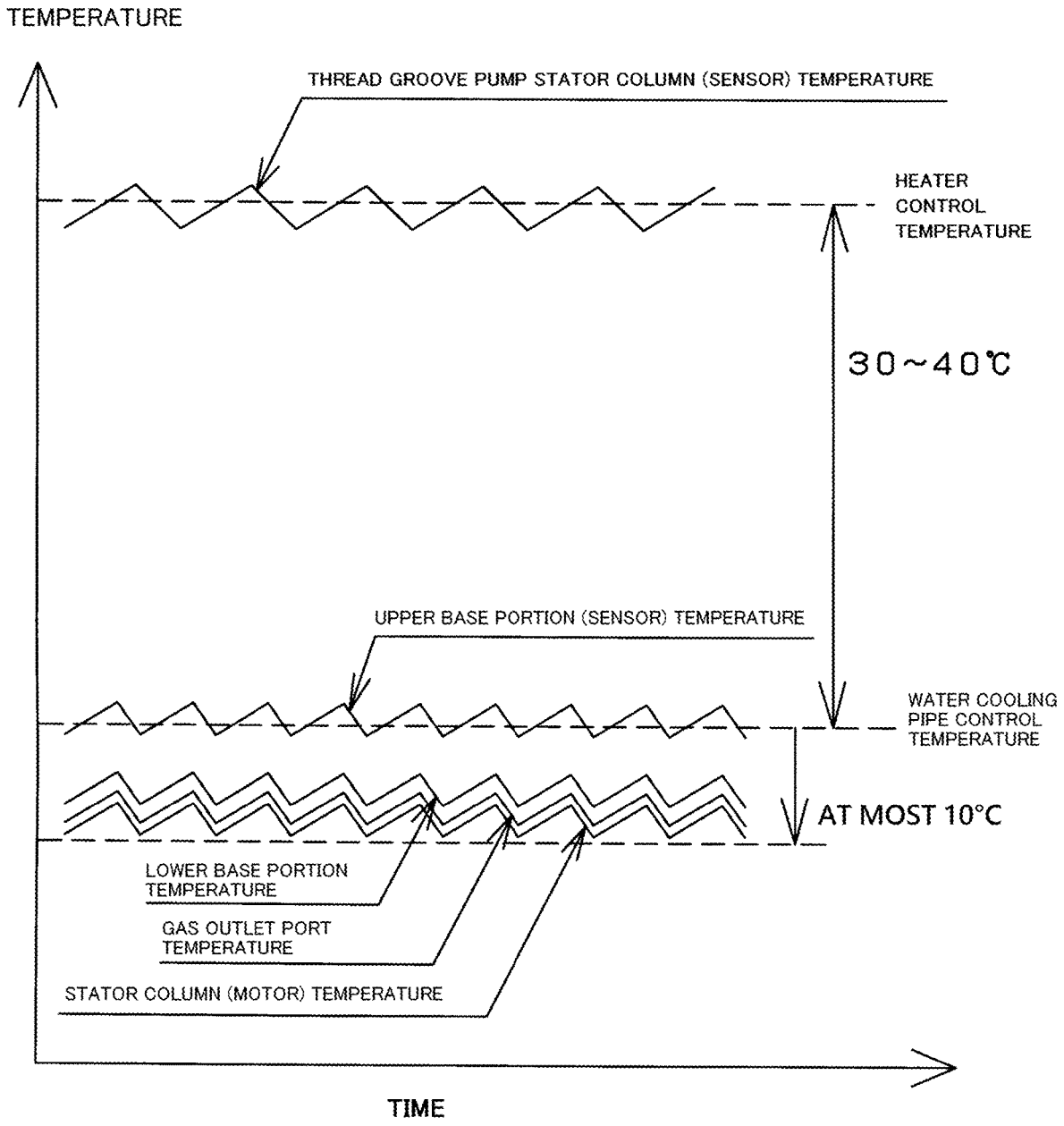
FIG. 6 is a diagram illustrating results of experiments based on the example of temperature control in FIG. 3.
Figure 7:
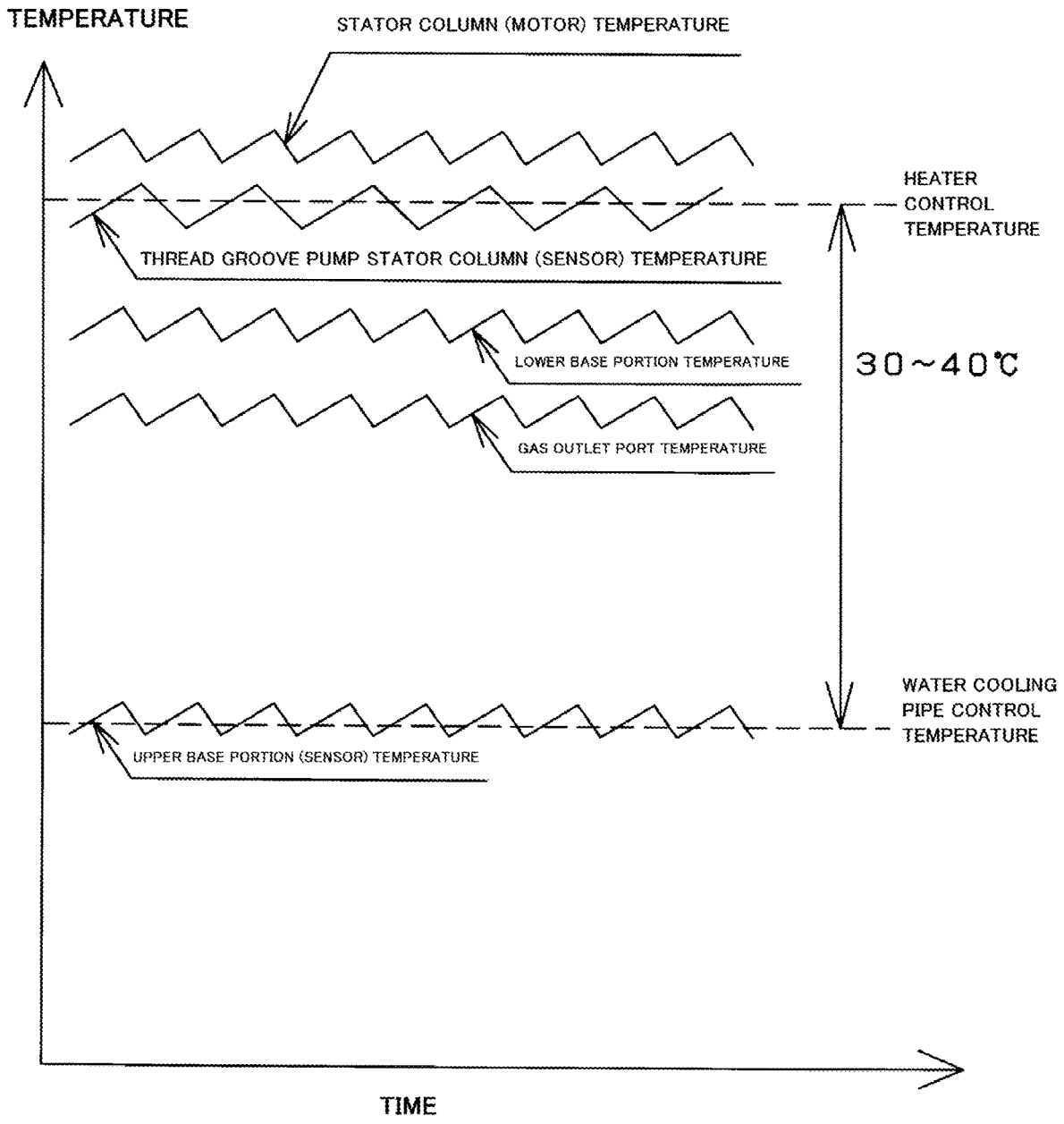
FIG. 7 is a diagram illustrating results of experiments based on the example of temperature control in FIG. 4.
Figure 8:
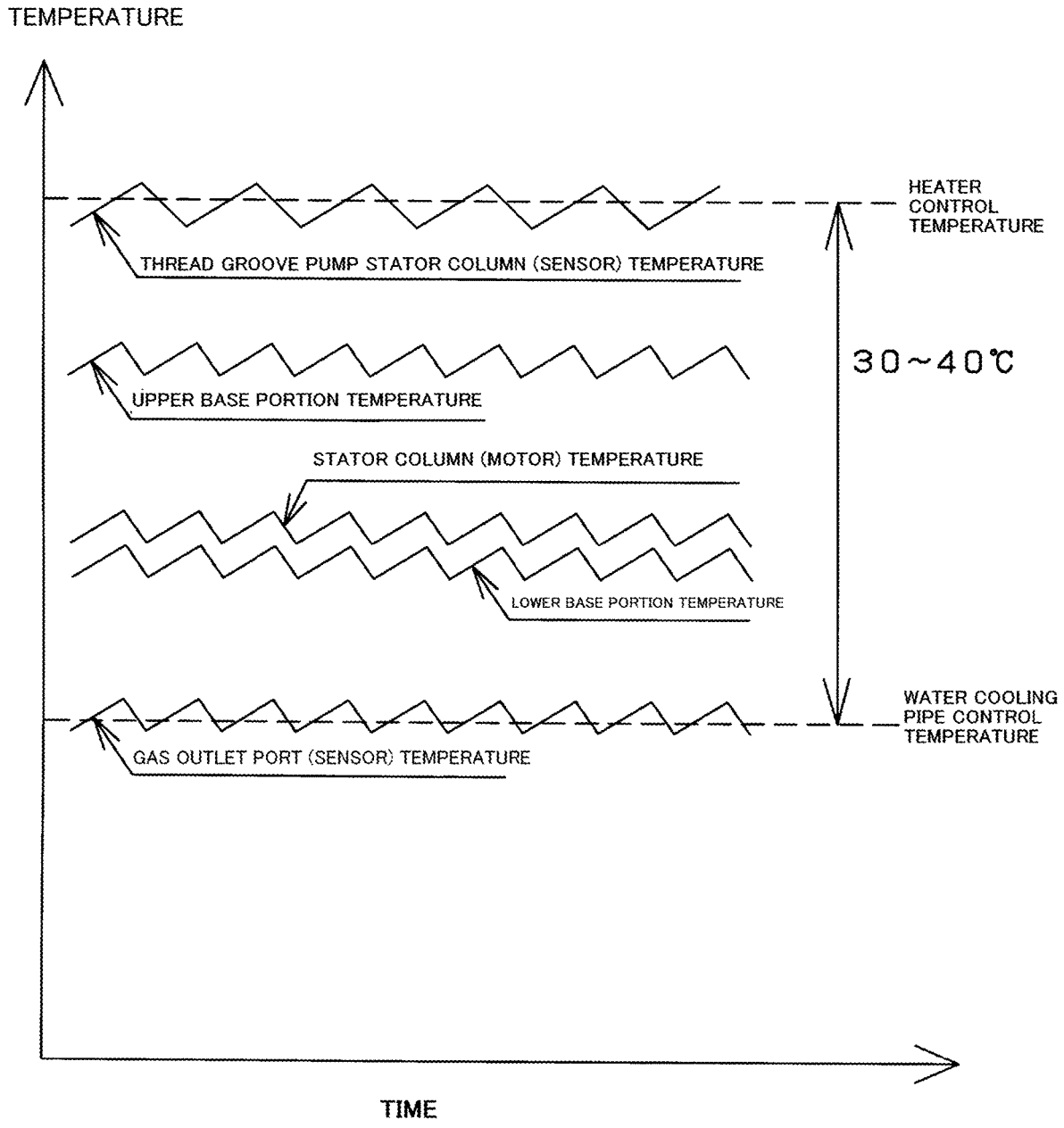
FIG. 8 is a diagram illustrating results of experiments based on the example of temperature control in FIG. 5.

FIG. 6 is a diagram illustrating results of experiments based on the example of temperature control in FIG. 3. FIG. 7 is a diagram illustrating results of experiments based on the example of temperature control in FIG. 4. FIG. 8 is a diagram illustrating results of experiments based on the example of temperature control in FIG. 5.

In FIGS. 6 to 8, a "heater control temperature" refers to the temperature of the heater 13 controlled based on the detection signal from the temperature sensor S1 for heater control. A "water cooling pipe control temperature" refers to the temperature of the cooling pipe 18 controlled based on the detection signal from the temperature sensor S2 for water cooling pipe valve control. These temperatures are set such that the difference between the temperatures is from 30° C. to 40° C.

In the example of temperature control where the cooling pipe 18 is installed both in the upper base B1 and in the lower base B2 as depicted in FIG. 3, the heater control temperature was able to be stably kept in a high temperature state where the heater control temperature was 30° C. to 40° C. higher than the water cooling pipe control temperature as indicated in the results of experiments in FIG. 6.

At the same time, the temperatures of the lower base B2, the gas outlet port 2, and the stator column 3 were stably kept in a low temperature state where the temperatures were at most 10° C. lower than the water cooling pipe control temperature.

Factors for the stable maintenance are expected to be that the thread groove pump stator 8 in which the heater 13 is installed is thermally insulated by the heat insulating means 10 including the heat insulating space 14 and the heat insulating spacer 15 and that the cooling pipe 18 installed in the upper base B1 exerts a cooling effect to suppress a rise in temperature mainly caused by the heats Q1, Q2, and Q4 illustrated in FIG. 2, while the cooling pipe 18 installed in the lower base B2 exerts a cooling effect to suppress a rise in temperature mainly caused by the heat Q3 illustrated in FIG. 2.

On the other hand, in the example of temperature control where the cooling pipe 18 was installed only in the upper base B1 as depicted in FIG. 4, the heater control temperature was stably kept to have a difference of 30° C. to 40° C. from the water cooling pipe control temperature even with a fluctuation in the flow rate of gas flowing through the gas channel R (a load on the pump) as indicated by the results of experiments in FIG. 7. However, phenomena occurred where the temperature of the stator column 3 was higher than the heater control temperature and where the temperatures of the gas outlet port 2 and the lower base B2 exceeded the water cooling pipe control temperature. A factor for the phenomena is expected to be that a rise in temperature mainly caused by the heat Q3 illustrated in FIG. 2 was difficult to suppress using only the cooling pipe 18 installed in the upper base B1 as depicted in FIG. 4.

In the example of temperature control where the cooling pipe 18 was installed only in lower base B2 as depicted in FIG. 5, the heater control temperature was stably kept to have a difference of 30° C. to 40° C. from the water cooling pipe control temperature even with a fluctuation in the flow rate of gas flowing through the gas channel R (a load on the pump) as indicated by the results of experiments in FIG. 8. However, a phenomenon occurred where, the temperatures of the stator column 3, the gas outlet port 2, and the upper base B1 all exceeded the water cooling pipe control temperature. A factor for the phenomena is expected to be that a rise in temperature mainly caused by the heats Q1, Q2, and Q4 illustrated in FIG. 2 was difficult to suppress using only the cooling pipe 18 installed in the lower base B2 as depicted in FIG. 5.

Second Embodiment

Figure 9:
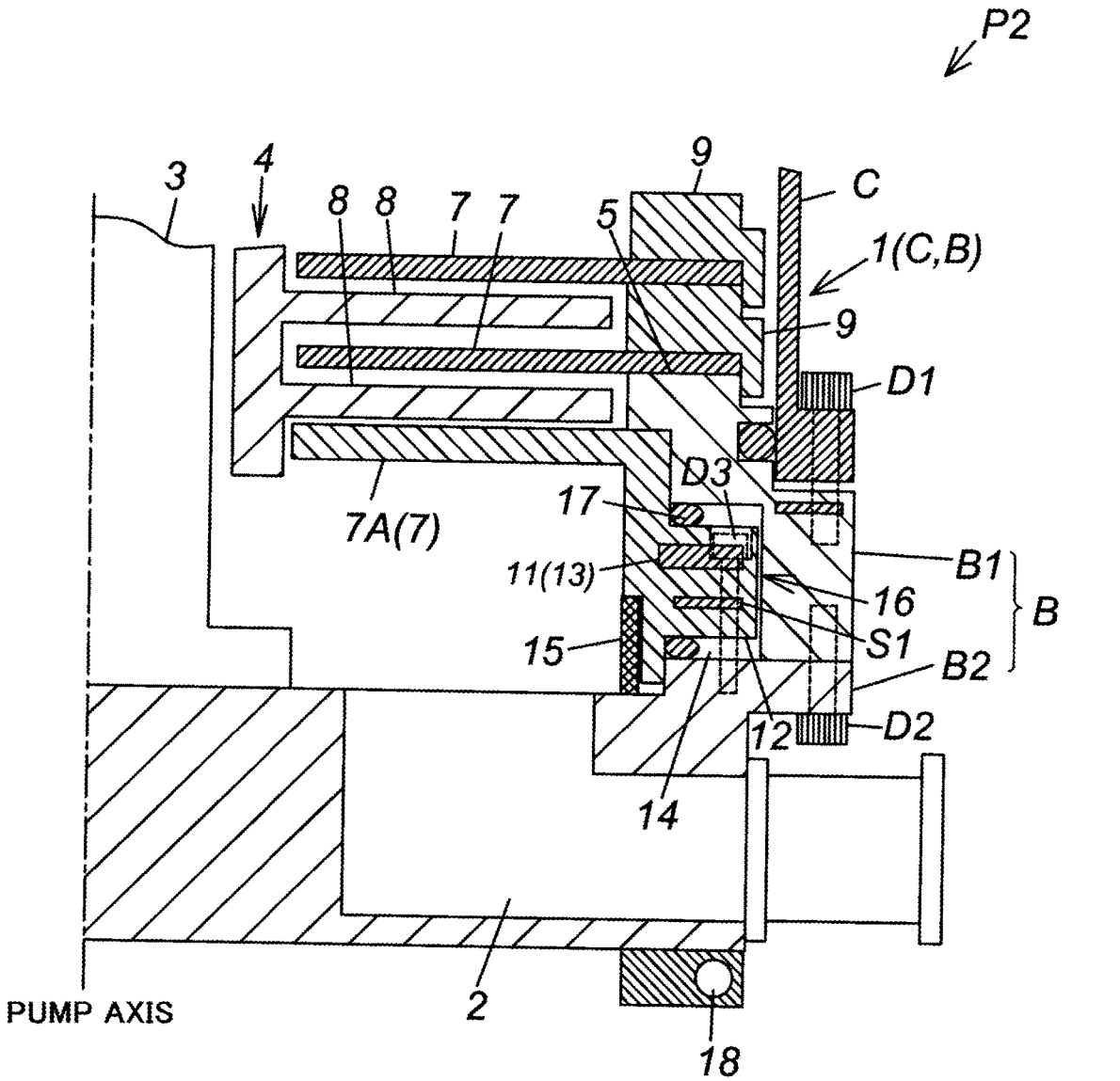
FIG. 9 is a sectional view depicting a part of a vacuum pump that is a second embodiment of the present invention.

FIG. 9 is a sectional view depicting a part of a vacuum pump that is a second embodiment of the present invention. The vacuum pump P2 in FIG. 9 is different from the vacuum pump P1 in FIG. 1 in a specific configuration of a gas channel R, with the remaining part of the configuration of the vacuum pump P2 is similar to the corresponding part of the configuration of the vacuum pump P1 in FIG. 1. Thus, identical members are denoted by identical reference numerals, with detailed descriptions thereof omitted.

In the vacuum pump P2 in FIG. 9, for a specific configuration of the gas channel R, a configuration similar to an inlet gas channel R1 in the vacuum pump P1 in FIG. 1 described above is also adopted for an exhaust side gas channel R2.

That is, the exhaust side gas channel R2 in the vacuum pump 1'2 in FIG. 9 is a channel formed using a rotor blade 6 integrally provided on the outer peripheral surface of the rotor 4 and a stator blade 7 that guides gas molecules to which a momentum acting toward a downstream of the gas channel R is applied by the rotor blade 6, toward the downstream of the channel R.

The vacuum pump P2 in FIG. 9 includes a plurality of stator blades 7 as stator components forming the exhaust side gas channel R2 included in the gas channel R. Among the plurality of stator blades 7, particularly the lowest stator blade 7A is configured to be thermally insulated from the other components by the heat insulating means 10. The thermally insulated lowest stator blade 7A is further configured to be directly heated by the heating means 11 based on heat conduction.

The heating means 11 in the vacuum pump P2 in FIG. 9 adopts, as a specific configuration thereof, a structure in which an attachment portion 12 is integrally formed on a base (outer peripheral portion) of the lowest stator blade 7A and in which a heater 13 is embedded in the attachment portion 12 so as to directly heat the lowest stator blade 7A based on heat conduction.

The heat insulating means 10 in the vacuum pump P2 in FIG. 9 adopts, as a specific configuration thereof, a configuration in which a heat insulating space 14 is set around the attachment portion 12 of the stator blade 7A and in which the whole lowest stator blade 7A including the attachment portion 12 is supported by an heat insulating spacer 15 and a structure in which a heat insulating spacer 15 positions the lowest stator blade 7A and the attachment portion 12 in a pump axis direction.

Also in the vacuum pump P2 in FIG. 9, a pump base B is divided into an upper base B1 and a lower base B2, and a recess portion 16 opposed to a downstream outer peripheral surface of the rotor 4 is formed in an inner surface of the pump base B. However, a component assembled into the recess portion 16 via a predetermined gap is the lowest stator blade 7A and the attachment portion 12. The predetermined gap is utilized as the heat insulating space 14.

In the vacuum pump P2 in FIG. 9, the pump base B and the lowest stator blade 7A are in contact with each other at an edge of the recess portion 16 in order to position the lowest stator blade 7A and the attachment portion 12 therefor in a pump radial direction. However, no external force (for example, a fastening force exerted by a fastening bolt) acts on this contact portion. Thus, substantially no heat conduction occurs via the contact portion.

The vacuum pump P2 in FIG. 9 described above adopts the configuration in which the lowest stator blade 7A, serving as a stator component forming the exhaust side gas channel R2 included in the gas channel R, is thermally insulated from the other components by the heat insulating means 10 and in which the thermally insulated lowest stator blade 7A is directly heated by the heating means 11 based on heat conduction, as described above. Thus, an <effect 1-2> and an <effect 2-2> are produced.

Effect 1-2

In the vacuum pump P2 in FIG. 9, the heating means 11 directly heats the lowest stator blade 7A based on heat conduction, and thus, the heating is prevented from being affected by the flow rate of discharged gas. Furthermore, the lowest stator blade 7A to be heated is thermally insulated by the heat insulating means 10, enabling concentrated and efficient heating of only the lowest stator blade 7A that needs to be made hot in order to prevent deposition of products and also enabling prevention of deposition of products in the exhaust side gas channel R2 as a result of the heating.

Effect 2-2

In the vacuum pump P2 in FIG. 9, the lowest stator blade 7A, which is heated by the heating means 11, is thermally insulated by the heat insulating means 10, thus preventing the components other than the lowest stator blade 7A from being heated by the heating means 11. Therefore, the vacuum pump P2 includes components to be prevented from increasing in temperature as a result of the heating by the heating means 11 and from decreasing in strength as a result of the increased temperature, for example, the rotor blade 6 and the stator blades 7 located above the lowest stator blade 7A, and enables such components to be effectively prevented from increasing in temperature and decreasing in strength. Thus, the vacuum pump P2 enables an increase in the number of rotations of the rotor blades 6 compared to conventional vacuum pumps, enhancing the pump emission performance.

In the above-described vacuum pump P2 in FIG. 9, only the lowest stator blade 7A, which is a stator component, is thermally insulated by the heat insulating means 10 and directly heated by the heating means 11 based on heat conduction. However, an alternative embodiment may adopt a configuration in which stator blades above the lowest stator blade 7A are also thermally insulated by the heat insulating means 10 including the heat, insulating space 14 and the heat insulating spacer 15 and in which the thermally insulated plurality of stator blades is directly heated by the heating means 11 including the heater 13 based on heat conduction.

Third Embodiment

Figure 10:
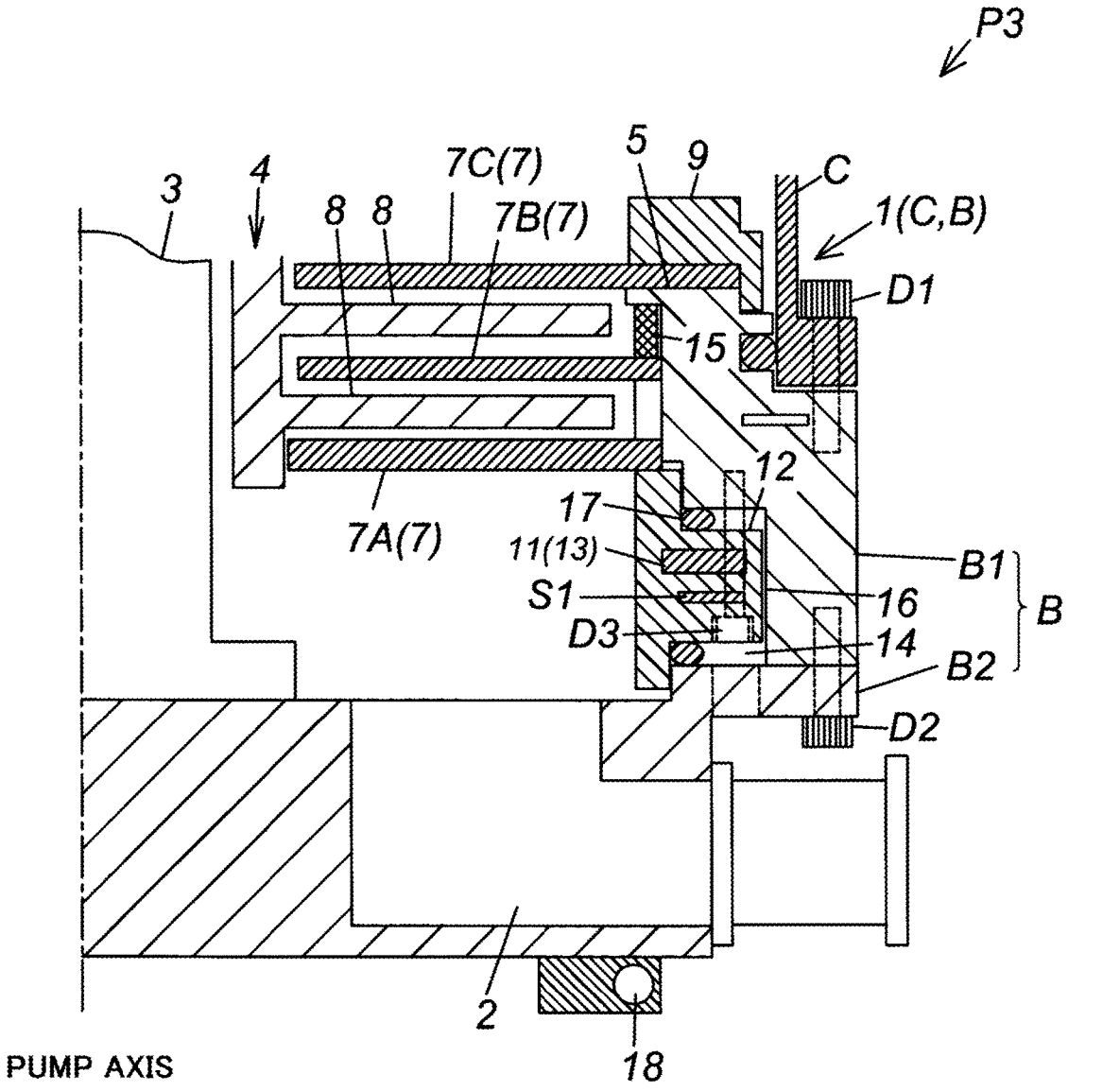
FIG. 10 is a sectional view depicting a part of a vacuum pump that is a third embodiment of the present invention.

FIG. 10 is a sectional view depicting a part of a vacuum pump that is a third embodiment of the present invention. A basic configuration of the vacuum pump in FIG. 10, for example, a specific configuration of a gas channel R, is similar to the corresponding configuration of the vacuum pump in FIG. 9. Thus, identical members are denoted by identical reference numerals, with detailed descriptions thereof omitted.

By adopting a <configuration A> and a <configuration B> described below, a vacuum pump P3 in FIG. 10 adopts a configuration in which a plurality of stator blades (specifically, a lowest stator blade 7A and a stator blade 7B that is the second stator blade from the lowest stator blade 7A) is thermally insulated by the heat insulating means 10 including a heat insulating space 14 and a heat insulating spacer 15 and in which the plurality of stator blades 7A and 7B are directly heated by a heating means 11 including a heater 13 based on heat conduction.

Configuration A

A stator blade positioning portion 5 at an upper end of a pump base B is extended to a lower portion of the third stator blade 7C from the lowest stator blade 7A. The third stator blade 7C is placed on the stator blade positioning portion 5. The heat insulating spacer 15 is interposed between the stator blade positioning portion 5 and the second stator blade 7B from the lowest stator blade 7A.

Configuration B

An attachment portion 12 is clamped to an upper base B1 located above the attachment portion 12 with a fastening means D4 to allow a force to act from a lower portion of the attachment portion 12. Thus, the following are integrated together: all components stacked and interposed between the attachment portion 12 and the stator blade positioning portion 5 at the upper end of the pump base B, that is, the lowest stator blade 7A placed on the attachment portion 12, the second stator blade 7B from the lowest stator blade 7A, a stator blade positioning spacer 9 interposed between the plurality of stator blades 7A and 7B, and the heat insulating spacer 15. Furthermore, the lowest stator blade 7A, the a stator blade positioning spacer 9, and the second stator blade 7B from the lowest stator blade 7A are thermally connected together based on heat conduction.

The above-described vacuum pump P3 in FIG. 3 adopts the configuration in which the plurality of stator blades 7A and 7B, serving as stator components forming an exhaust side gas channel R2 included in the gas channel R, is thermally insulated from the other components by the heat insulating means 10 and in which the thermally insulated plurality of stator blades 7A and 7B are directly heated by the heating means 11 based on heat conduction. Thus, effects similar to the above-described effects of the vacuum pump P2 in FIG. 2 (<effect 1-2> and <effect 2-2>) are produced.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising a pump base configured of an upper base portion and a lower base portion, a rotor arranged on the lower base portion, rotor blades disposed on an outer peripheral surface of the rotor, stator blades disposed alternately, stator blade spacers positioning the stator blades, a supporting and driving means for supporting the rotor so as to enable the rotor to rotate around an axis thereof and rotationally driving the rotor, and a gas channel through which gas sucked by rotation of the rotor is guided to an outlet port, wherein the vacuum pump comprises a stator component, forming an exhaust side gas channel in the gas channel and providing on an outer peripheral portion an attachment portion which is assembled into the upper base portion and the lower base portion via a gap;

a heat insulating space that is the gap, thermally insulating the attachment portion from the upper base portion and the lower base portion;

a seal means being provided between the upper base portion and the attachment portion and between the lower base portion and the attachment portion, and sealing the gas channel from the heat insulating space;

a fastening means fastening the attachment portion to the upper base portion or the attachment portion to the lower base portion;

a heating means for heating the stator component;

a cooling portion cooling heat conducting to the stator blades through the upper base portion; and a valve adjusting a supply of a cooling media flowing in the cooling portion, wherein a temperature sensor is provided in the upper base portion being cooled by the cooling portion, the upper base portion supports the stator blades or the stator blade spacers, the supply of the cooling media of the valve is controlled based on a signal of the temperature sensor the heating means is a heater embedded in the attachment portion, and the heat insulating space is open to the atmosphere.

2. The vacuum pump according to claim 1, wherein the exhaust side gas channel is a channel shaped like a thread groove and formed of the outer peripheral surface of the rotor and a thread groove pump stator opposed to the outer peripheral surface, and the stator component is the thread groove pump stator.

3. The vacuum pump according to claim 2, wherein the upper base portion and the lower base portion are structured so as to conduct heat to and from each other.

4. The vacuum pump according to claim 1, wherein the exhaust side gas channel is a channel formed of the rotor blades and the stator blades, and the stator component is the stator blades.

5. The vacuum pump according to claim 4, wherein the upper base portion and the lower base portion are structured so as to conduct heat to and from each other.

6. The vacuum pump according to claim 1, wherein the upper base portion and the lower base portion are structured so as to conduct heat to and from each other.

7. The vacuum pump according to claim 6, wherein the cooling portion is provided in both or one of the upper base portion and the lower base portion.

8. The vacuum pump according to claim 1, wherein the vacuum pump additionally provides a heat insulating spacer which is interposed between the stator component and the lower base portion, and supports the stator component by fastening the stator component to the lower base portion by the fastening means.

* * * * *